US006394566B1

(12) United States Patent
Slivon et al.

(10) Patent No.: US 6,394,566 B1
(45) Date of Patent: May 28, 2002

(54) WORKSTATION AND SPRING-ASSISTED DOOR THEREFOR

(75) Inventors: George R. Slivon; Jack A. Parise, both of Kenosha; Kenneth C. Happ, Burlington; Gordon A. Putney, Lake Geneva, all of WI (US)

(73) Assignee: Snap-on Technologies, Inc., Lincolnshire, IL (US)

( * ) Notice: Subject to any disclaimer, the term of this patent is extended or adjusted under 35 U.S.C. 154(b) by 0 days.

(21) Appl. No.: 09/628,051

(22) Filed: Jul. 28, 2000

Related U.S. Application Data

(60) Provisional application No. 60/146,639, filed on Jul. 30, 1999.

(51) Int. Cl.[7] ..... B25H 3/00

(52) U.S. Cl. ..... 312/323; 312/325; 160/201

(58) Field of Search ..... 312/323, 325, 312/327, 902; 160/130, 133, 201, 206

(56) References Cited

U.S. PATENT DOCUMENTS

| | | | |
|---|---|---|---|
| 2,681,699 | A | 6/1954 | Lissaman |
| 2,740,471 | A | 4/1956 | Follett |
| 2,849,270 | A | 8/1958 | Warnock |
| 3,092,428 | A | 6/1963 | Kerschner |
| 3,151,858 | A | 10/1964 | Urquhart |
| 3,224,494 | A | 12/1965 | Houk |
| 3,493,033 | A | 2/1970 | McGirr |
| 3,698,464 | A | 10/1972 | Scheitel |
| 3,730,378 | A | 5/1973 | Albinson et al. |
| 4,289,362 | A | 9/1981 | Kramer |
| 4,383,721 | A | 5/1983 | Knaack et al. |
| 4,518,208 | A | 5/1985 | Marder |
| 5,215,366 | A | 6/1993 | Givens |
| 5,221,132 | A | 6/1993 | Combs et al. |
| 5,269,599 | A | 12/1993 | Moring |
| 5,482,162 | A | 1/1996 | Dickinson |
| 5,588,659 | A | 12/1996 | Boes et al. |
| 5,593,203 | A | 1/1997 | Abbott |
| 5,678,693 | A | 10/1997 | Tapp et al. |
| 5,882,099 | A | 3/1999 | Salice |

FOREIGN PATENT DOCUMENTS

| | | |
|---|---|---|
| JP | 666073 | 3/1994 |

*Primary Examiner*—Peter M. Cuomo
*Assistant Examiner*—Michael J. Fisher
(74) *Attorney, Agent, or Firm*—Seyfarth Shaw

(57) ABSTRACT

A storage riser for mounting atop a work surface has an open-front wall structure including rear, side and top walls and a bifold door assembly for closing the front opening. The door assembly has an upper panel hingedly connected to the front of the top wall and a lower panel hingedly connected to the bottom of the upper panel for pivotal movement between a vertical, unfolded, closed position and a non-vertical, folded, open position disposed in the storage compartment adjacent to the top wall. Coupling brackets respectively project inwardly of the compartment from the opposite sides of the lower panel adjacent to its upper end, the brackets respectively carrying guide rollers which respectively roll in channel tracks on the side walls. Opening of the door assembly is assisted by gas springs, respectively disposed adjacent to the side walls and having cylinders pivotally coupled to the coupling brackets and rods pivotally coupled to the side walls adjacent to the lower end of the front opening.

18 Claims, 3 Drawing Sheets

WORKSTATION AND SPRING-ASSISTED DOOR THEREFOR

RELATED APPLICATION

This application claims the benefit of the filing date of copending U.S. Provisional Application No. 60/146,639, filed Jul. 30, 1999.

BACKGROUND

This application relates to storage systems, such as tool storage systems for use by mechanics, service technicians and the like for storing tools and associated equipment. It is well known to provide such storage systems in the form of interconnectable modules, including a base unit or module, such as a tool cabinet mounted on wheels or casters (commonly referred to as a "roll cabinet"), and add-on storage modules which can be mounted on the base module and/or on each other for building a multi-faceted storage system.

One prior type of storage unit or module is known as a "riser" and constitutes an open-front workstation adapted to be mounted atop a base storage unit or module, such as a roll cabinet. Such risers typically include side walls and a top wall interconnected by a slotted rear panel, on which can be hung shelving units, individual tools or the like. Since mechanics, technicians and the like sometimes mount on the riser tools or other apparatus which they would like to leave in place overnight, or while unattended, a need has arisen to provide an effective door or closure system for such risers which can be locked or otherwise secured.

SUMMARY

There is disclosed an improved storage system or storage unit which avoids the disadvantages of prior systems or units while affording additional structure and operating advantages.

An important feature is the provision of a closeable riser or other workstation unit.

In connection with the foregoing feature, another feature is the provision of a storage unit of the type set forth, which provides a front door which, in the open condition, is stowable within the unit and occupies minimal space.

In connection with the foregoing feature, another feature is the provision of a workstation door of the type set forth which is bias-assisted during opening.

In connection with the foregoing features, a further feature is the provision of a workstation and door arrangement therefor which are of simple and economical construction.

BRIEF DESCRIPTION OF THE DRAWINGS

For the purpose of facilitating an understanding of the subject matter sought to be protected, there is illustrated in the accompanying drawings an embodiment thereof, from an inspection of which, when considered in connection with the following description, the subject matter sought to be protected, its construction and operation, and many of its advantages should be readily understood and appreciated.

DETAILED DESCRIPTION

Figure 1:
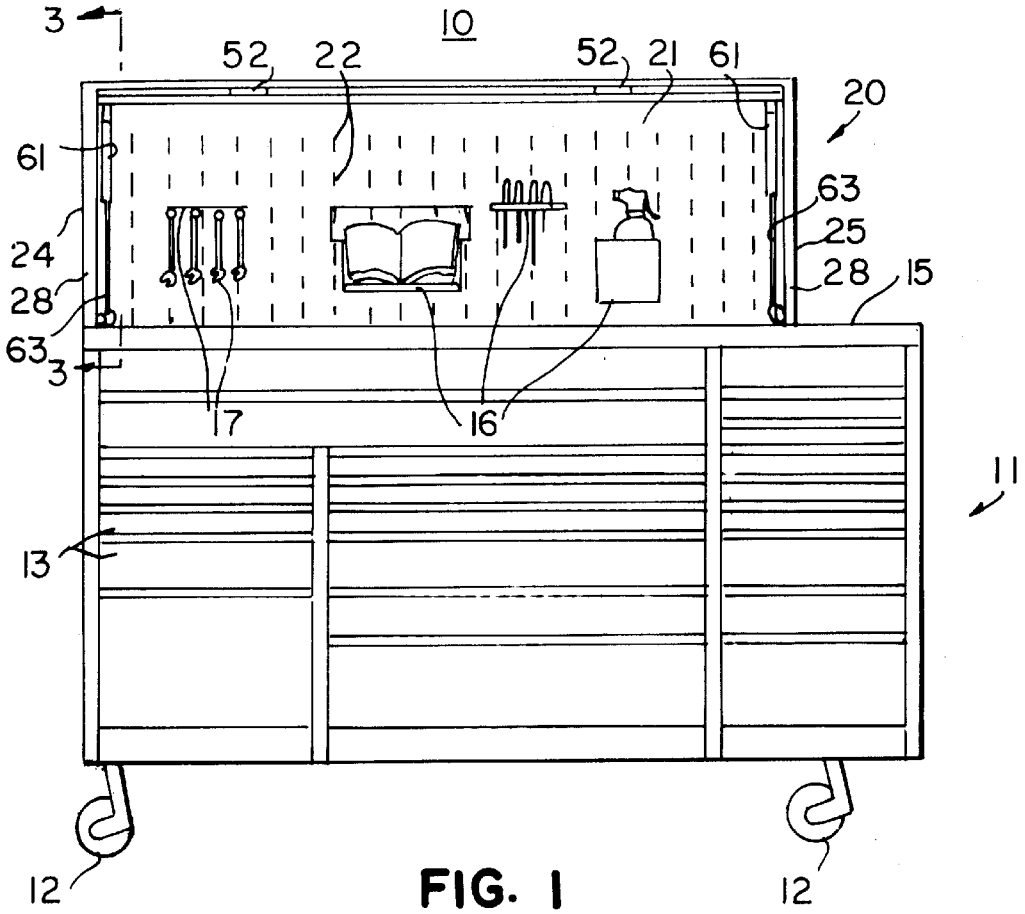
FIG. 1 is a front elevational view of a storage system including a riser workstation shown in the open condition.
Figure 2:
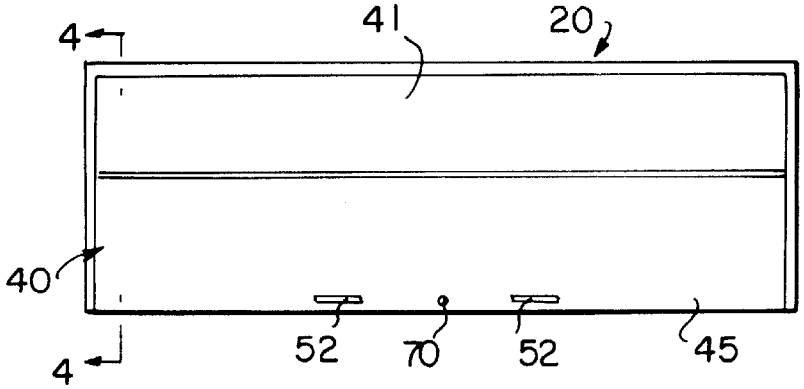
FIG. 2 is a front elevational view of the workstation of FIG. 1, shown in the closed condition.

Referring to FIGS. 1 and 2, there is illustrated a storage system generally designated by the numeral 10, including a roll cabinet 11 mounted on casters 12 and having a plurality of horizontal drawers 13 therein and provided with a substantially flat, horizontal upper work surface 15. Mounted atop the work surface 15 is a workstation of the type commonly referred to as a "riser," generally designated by the numeral 20, which may be secured to the roll cabinet 11 by suitable means.

Figure 3:
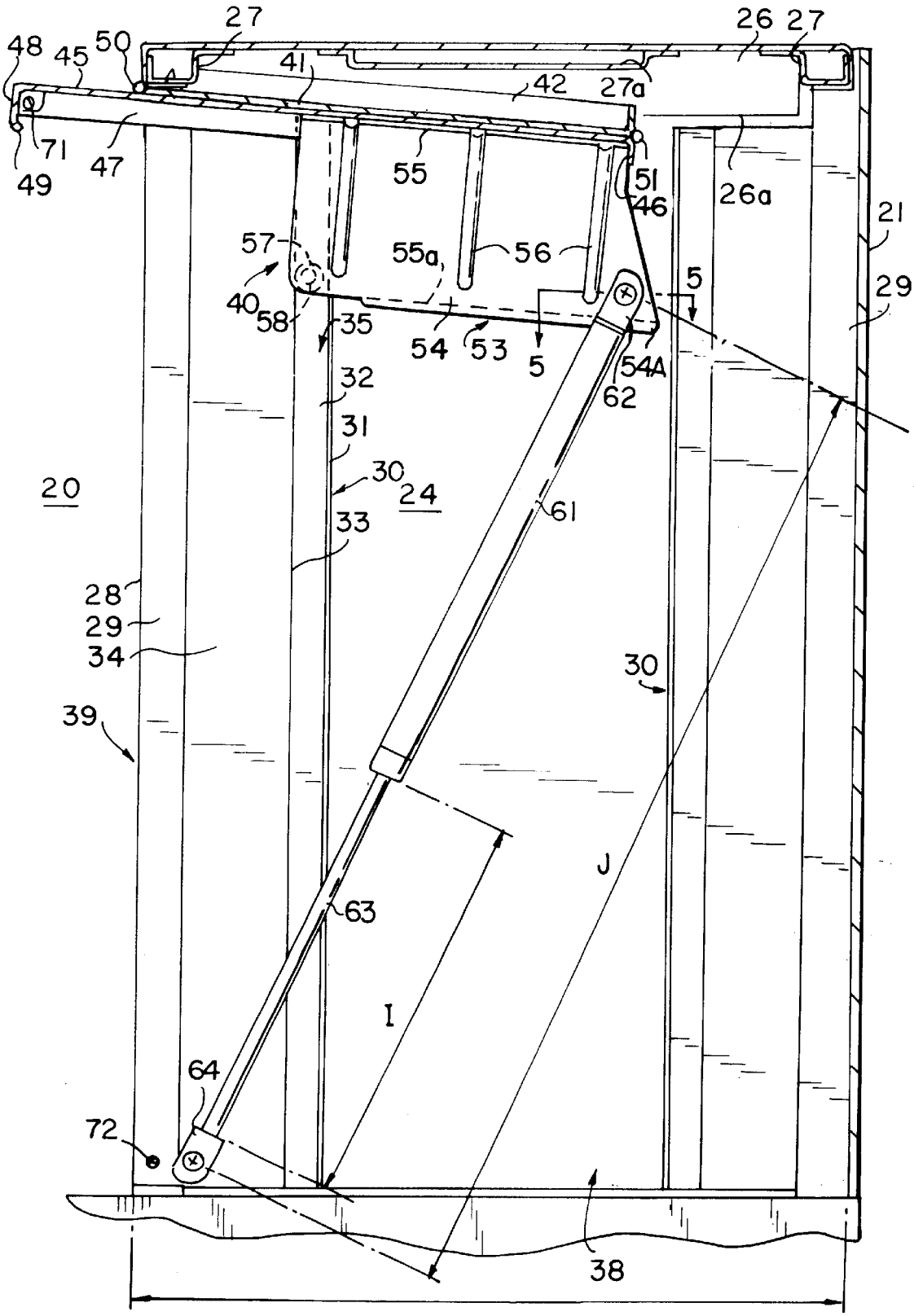
FIG. 3 is an enlarged, fragmentary view in vertical section taken along the line 3—3 in FIG. 1.
Figure 4:
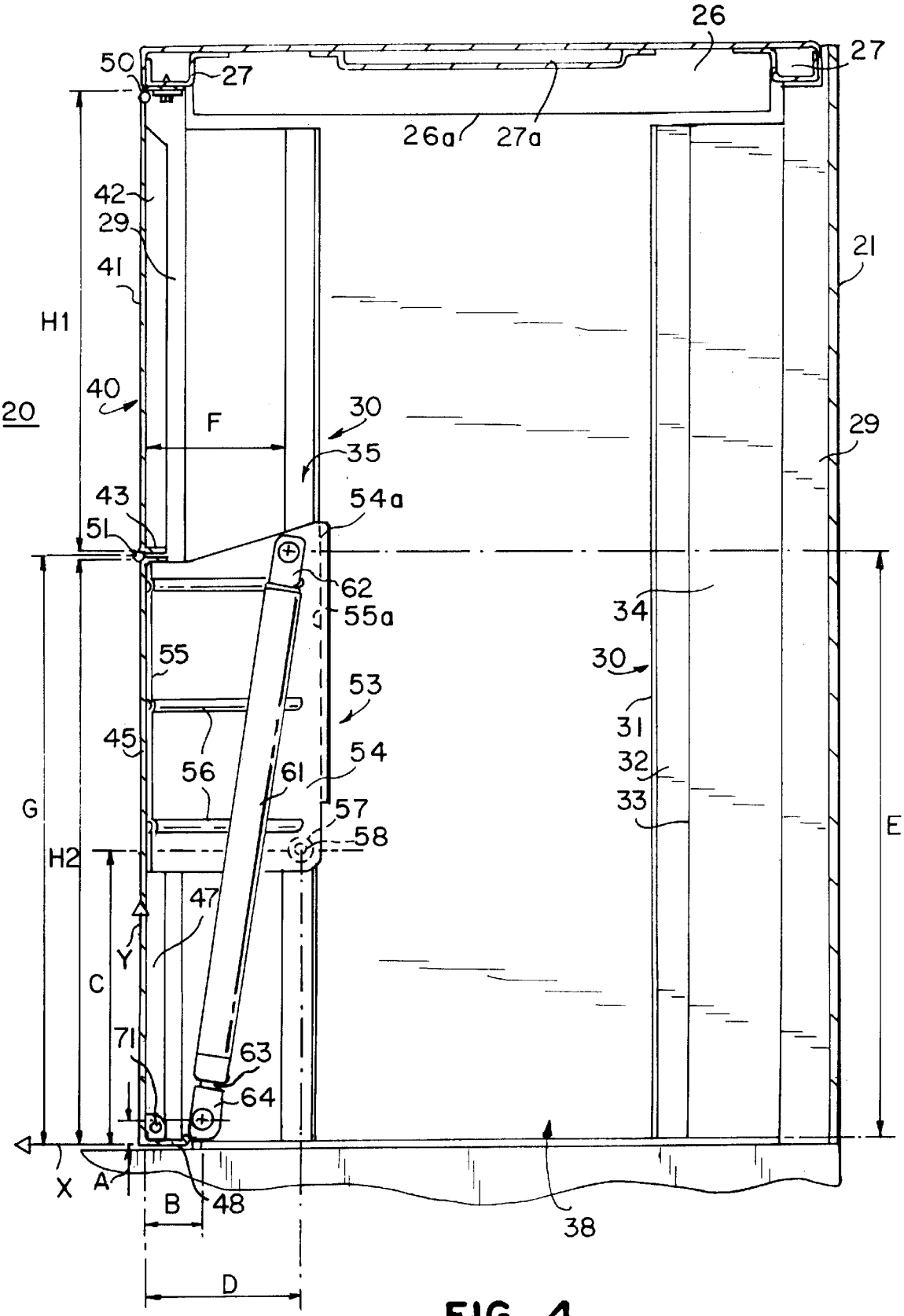
FIG. 4 is an enlarged view in vertical section taken along the line 4—4 in FIG. 2.

Referring also to FIGS. 3 and 4, the riser 20 includes an upstanding, rectangular rear panel 21 having formed therethrough a plurality of openings 22, which may include elongated slots and circular holes. The openings 22 are arranged in rows and columns, all in a known manner, to facilitate mounting thereon of shelf units 16 or individual tools 17, also in a known manner. Interconnected with the rear panel 21 at the opposite side edges thereof and projecting forwardly therefrom are parallel, upstanding side panels 24 and 25, the upper ends of the rear panel 21 and the side panels 24 and 25 all being interconnected by a horizontal top panel 26. The top panel 26 has depending flanges 26*a* at the opposite ends thereof, which are attached by suitable means to the upper ends of the side panels 24 and 25. Also provided on the underside of the top panel 26 are reinforcing channels 27 along the front and rear edges and a reinforcing channel 27*a* midway between the front and rear edges.

The side panels 24 and 25 are substantially identical, wherefore the details of only panel 24 are shown. Each of panels 24 and 25 has, along each of the front and rear edges thereof, a laterally inwardly extending flange 28 substantially perpendicular to the side panel and integral at its distal end with an inwardly extending lip 29 disposed substantially parallel to the side panel. Each of the side panels 24 and 25 also includes a pair of vertically extending reinforcing channels 30, respectively adjacent to the front and rear edges of the side panel. Each of the reinforcing channels 30 has an inner wall 31 disposed perpendicular to the side panel and integral at its laterally outer end with a base wall 32, which is fixed to the side panel and projects toward the adjacent (front or rear) edge of the side panel and is integral at its outer edge with a laterally inwardly projecting outer wall 33 substantially parallel to the inner wall 31 and of equal lateral extent. The outer wall 33 is integral at its distal edge with an attachment flange 34 which is attached by suitable means to the adjacent one of the lips 29. The walls 31–33 of the forwardmost reinforcing channel 30 cooperate to define a vertical, channel-shaped guide track 35, for a purpose to be described below.

The panels 21 and 24–26 form a wall structure and cooperate with the work surface 15 to define a storage compartment 38, and the front reinforcing channel 27 and lips 29 cooperate with the work surface 15 to define a rectangular opening 39 into the storage compartment 38.

The front of the riser 20 is closed by a bifold door assembly, generally designated by the numeral 40. The door assembly 40 has a flat, rectangular upper panel 41 provided along its opposite side edges with inwardly projecting side flanges 42 (one shown), and provided at its lower edge with an inwardly projecting flange 43. The door assembly 40 also includes a flat, rectangular lower panel 45 provided at its upper edge with an inwardly projecting top flange 46 and provided along its opposite side edges, respectively, with inwardly projecting side flanges 47 (one shown) and along its lower edge with an inwardly projecting bottom flange 48, provided at its inner edge with an upstanding lip 49 disposed substantially parallel to the lower panel 45.

A piano-type hinge 50 hingedly couples the upper end of the upper panel 41 to a horizontal surface on the forward one of the top panel reinforcing channels 27. A piano-type hinge 51 hingedly interconnects the bottom flange 43 of the upper panel 41 and the top flange 46 of lower panel 45. The hinges 50 and 51 cooperate to permit movement of the bifold door assembly 40 between a folded open condition, illustrated in FIGS. 1 and 3, and an unfolded, vertically disposed, closed position, illustrated in FIGS. 2 and 4, closing the front of the riser 20. To facilitate movement between these positions, the door assembly 40 may be provided with a pair of handles 52 (FIGS. 1 and 2) projecting outwardly from the lower end of the lower panel 45.

Figure 5:
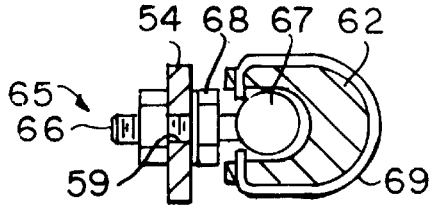
FIG. 5 is a further enlarged fragmentary sectional view taken along the line 5—5 in FIG. 3.

Since the door assembly 40 could have considerable weight, particularly in wide risers (which are currently available in widths up to 72 inches), the riser 20 also includes a pair of gas springs 60 to assist in opening the door assembly 40. In this regard, the door assembly 40 is provided with a pair of mounting brackets 53, attached to the riser 20 respectively adjacent to the opposite sides thereof. The mounting brackets 53 are substantially mirror images of each other, wherefore only one is shown. Each mounting bracket 53 is generally Z-shaped, having a generally flat main panel 54, which is generally rectangular in shape, with a triangular outwardly projecting wing portion 54*a*. Integral with the main panel 54 along one longitudinal edge thereof and projecting therefrom substantially perpendicular thereto is a rectangular attachment flange 55, which is fixedly secured by suitable means to the inner surface of the lower panel 45 adjacent to the upper edge thereof, with the main panel 54 abutting the inner surface of the associated lower panel side flange 47. Integral with the main panel 54 along the other longitudinal edge thereof and extending substantially perpendicular thereto in the opposite direction from the flange 55 is a stop flange 55*a*. Stiffening ribs 56 may be formed in the main panel 54 and the attachment flange 55 at spaced-apart locations thereon. A guide roller 57 is rotatably mounted on a shaft 58 which projects laterally outwardly from the main panel 54, adjacent to the lower rear corner thereof, the roller 57 being disposed in the adjacent one of the guide tracks 35 for rolling engagement therewith. Formed through the wing 54a of the main panel 54 is a hole 59 (see FIG. 5) to facilitate attachment of the associated gas spring 60.

More specifically, the gas springs 60 are formed as mirror images of each other, wherefore only one will be described in detail. Each gas spring 60 has an elongated pneumatic cylinder 61 provided at one end with a mounting socket 62, and an elongated rod 63 which is telescopically slidable into and out of the cylinder 61 coaxially therewith in a known manner. The rod 63 is provided at its distal end with a mounting socket 64. The mounting sockets 62 are, respectively, coupled to the mounting brackets 53 and the mounting sockets 64 are, respectively, coupled to the forward ones of the reinforcing channels 30, by ball studs 65 (one shown). More specifically, referring to FIG. 5, each ball stud 65 has a threaded shank 66, which is received through the opening 59 in the mounting bracket 53 or an opening (not shown) in the lower end of the reinforcing channel 30, a coupling ball 67 at the other end of the shank 66, and a hex driving portion 68 therebetween. The ball 67 is retained in the socket 62 (or 64) by a clip 69, all in a known manner, thereby providing a pivotal coupling between the cylinder 61 and the door panel mounting bracket 53 and between the cylinder rod 63 and the reinforcing channel 30, with pivoting about the axes of the ball stud shanks 66.

The door assembly 40 may also be provided with a lock assembly 70 including a cam rotatable with a key lock to extend and retract lock rods 71 (one shown) into or from keeper holes 72 (one shown) in the side panel lips 29, again all in a well-known manner.

In use, it will be appreciated that the gas springs 60 are biased toward the extended configuration illustrated in FIG. 3, for holding the door assembly 40 in its open condition The parts are so dimensioned and positioned that, when the door assembly 40 is in its closed condition and unlocked, a slight lifting and outward pulling force on the handles 52 will start movement of the door assembly 40 toward its open condition, whereupon the gas springs 60 will take over and assist the opening movement, which is guided by the rollers 57 rolling in the guide tracks 35. Return of the door assembly to its closed condition will, of course, be assisted by gravity. The door assembly 40 is stopped in its closed condition by engagement of the stop flanges 55*a* of the mounting brackets 53 with the inner walls 31 of the front ones of the reinforcing channels 30. This engagement may be cushioned by suitable cushioning members (not shown) mounted on the stop flanges 55*a*.

The locations of the several pivot points in the door assembly 40 relative to one another are important for proper operation of the door assembly 40. In FIGS. 3 and 4, the reference dimensions are relative to a datum line running along the lower outer edge of the lower door panel 45 in its closed condition (extending into the paper in FIG. 4) and defining the intersection between a horizontal "X" axis, extending perpendicular to the lower panel 45, and a vertical "Y" axis, respectively indicated by the open arrowheads in FIG. 4. The pivot axis of the socket 64 is spaced a distance A from the X axis in the closed position of the door assembly 40 and is spaced a distance B from the Y axis. The axis of the roller 57 is spaced a distance C from the X axis and a distance D from the Y axis. The pivot axis of the socket 62 is spaced a distance E from the X axis and a distance F from the Y axis. The pivot axis of the hinge 51 is spaced a distance G from the X axis. The upper door panel 41 has a height HI and the lower door panel 45 has a height H2. The extended length of the rod 63 from the cylinder 61 to the socket 64 in the open condition of the door assembly 40 is a distance I (FIG. 3), while the overall distance between the pivot axes of the sockets 62 and 64 in the open condition of the door assembly 40 is a distance J. In a constructional embodiment of the invention, the aforementioned distances, in inches, may be as follows:

| | | |
|---|---|---|
| A = 0.500 | B = 1.250 | C = 6.250 |
| D = 3.390 | E = 12.600 | F = 3.125 |
| G = 12.565 | H1 = 9.772 | H2 = 12.480 |
| I = 8.000 | J = 19.750 | |

The foregoing dimensions apply to a riser 20 having an overall height of about 23.5 inches. It will be appreciated that, for risers of other heights, different dimensions would apply, although approximately the same ratios among dimensions would be maintained.

The matter set forth in the foregoing description and accompanying drawings is offered by way of illustration only and not as a limitation. While a particular embodiment has been shown and described, it will be obvious to those skilled in the art that changes and modifications may be made without departing from the broader aspects of applicants' contribution. The actual scope of the protection sought is intended to be defined in the following claims when viewed in their proper perspective based on the prior art.

We claim:

1. A storage unit comprising:

a wall structure defining a storage compartment and having a generally rectangular opening therein communicating with the storage compartment;

a bifold door assembly carried by the wall structure for pivotal movement between an unfolded closed position closing the opening and a folded open position disposed in the storage compartment and;

a bias mechanism including a gas spring having a rod coupled to the wall structure adjacent to a lower end of the opening and a cylinder coupled to the lower panel, the gas sprint resiliently urging the door assembly toward its open position.

2. The storage unit of claim 1, wherein the opening is disposed substantially vertically in use.

3. The storage unit of claim 2, wherein the door assembly includes panels coupled to each other and to the wall structure for pivotal movement about generally horizontal axes.

4. The storage unit of claim 3, wherein the door assembly is pivotally coupled to the wall structure adjacent to the top of the opening.

5. The storage unit of claim 1, wherein the wall structure includes upstanding rear and side walls and a top wall with an open front forming the opening.

6. The storage unit of claim 5, wherein the door assembly is pivotally coupled to the top wall adjacent to the opening.

7. The storage unit of claim 1, and further comprising a lock mechanism for locking the door assembly in its closed position.

8. A storage unit comprising:

a wall structure defining a storage compartment and having a generally vertical opening therein communicating with the storage compartment;

a bifold door assembly including upper and lower panels hingedly connected together with the upper panel hingedly connected to the wall structure for pivotal movement between an unfolded closed position closing the opening and a folded open position, and a bias mechanism including a as spring having a rod coupled to the wall structure adjacent to a lower end of the opening and a cylinder coupled to the lower panel, the gas spring resiliently urging the door assembly toward its open position.

9. The storage unit of claim 8, and further comprising a coupling bracket connected to the lower panel adjacent to its upper end and to one side thereof and projecting therefrom inwardly of the storage compartment, the cylinder being pivotally coupled to the coupling bracket and the rod being pivotally coupled to the wall structure.

10. The storage unit of claim 9, and further comprising a first guide structure on the wall structure and second guide structure on the coupling bracket and disposed for guiding engagement with the first guide structure for guiding movement of the door assembly between its open and closed positions.

11. The storage unit of claim 10, wherein the first guide structure includes a channel track and the second guide structure includes a roller disposed for rolling engagement in the channel track.

12. The storage unit of claim 8, wherein the bias mechanism includes two bias assemblies respectively disposed adjacent to opposite sides of the opening.

13. A storage unit comprising:

a wall structure defining a storage compartment and having a generally rectangular opening therein communicating with the storage compartment and disposed substantially vertically in use, a bifold door assembly including upper and lower panels hingedly connected together with the upper panel hingedly connected to the wall structure for pivotal movement between an unfolded closed position closing the opening and a folded open position disposed in the storage compartment, and a bias mechanism including a gas spring having a rod coupled to the wall structure adjacent to a lower end of the opening and a cylinder coupled to the lower panel, the gas spring resiliently urging the door assembly toward its open position.

14. The storage unit of claim 13,wherein the door assembly includes panels coupled to each other and with at least one panel coupled to the wall structure for pivotal movement about generally horizontal axes.

15. The storage unit of claim 14, wherein the door assembly is pivotally coupled to the wall structure adjacent to the top of the opening.

16. The storage unit of claim 13, wherein the wall structure includes upstanding rear and side walls and a top wall with an open front forming the opening.

17. The storage unit of claim 13, wherein the cylinder is pivotally coupled to the coupling bracket and the rod is pivotally coupled to the wall structure, and further comprising a channel track formed on the wall structure, and a guide roller carried by the coupling bracket and disposed for rolling engagement in the guide track for guiding movement of the door assembly between its open and closed positions.

18. The stage unit of claim 13, wherein the bias mechanism includes two gas springs respectively disposed adjacent to opposite sides of the opening.

* * * * *

UNITED STATES PATENT AND TRADEMARK OFFICE

CERTIFICATE OF CORRECTION

PATENT NO. : 6,394,566 B1
DATED : May 28, 2002
INVENTOR(S) : Slivon et al.

It is certified that error appears in the above-identified patent and that said Letters Patent is hereby corrected as shown below:

Column 6,
Line 51, "stage" should be -- storage --.

Signed and Sealed this

Sixth Day of August, 2002

*Attest:*

*Attesting Officer*

JAMES E. ROGAN
*Director of the United States Patent and Trademark Office*